US007850787B2

(12) United States Patent
Buser

(10) Patent No.: US 7,850,787 B2
(45) Date of Patent: Dec. 14, 2010

(54) DISHWASHING MACHINE

(75) Inventor: Josef Arnold Buser, Schoenenberg-Kuebelberg (DE)

(73) Assignee: Whirlpool Corporation, Benton Harbor, MI (US)

( * ) Notice: Subject to any disclaimer, the term of this patent is extended or adjusted under 35 U.S.C. 154(b) by 212 days.

(21) Appl. No.: 11/850,945

(22) Filed: Sep. 6, 2007

(65) Prior Publication Data

US 2008/0060688 A1 Mar. 13, 2008

(30) Foreign Application Priority Data

Sep. 8, 2006 (EP) ..... 06120384

(51) Int. Cl.
*B08B 3/00* (2006.01)

(52) U.S. Cl. ..... 134/56 D

(58) Field of Classification Search ..... 134/56 D
See application file for complete search history.

(56) References Cited

U.S. PATENT DOCUMENTS 3,162,335 A * 12/1964 Kogan et al. ..... 222/212
4,851,171 A * 7/1989 Shimizu et al. ..... 264/40.5
5,133,487 A * 7/1992 Russi ..... 222/651
5,311,175 A * 5/1994 Waldman ..... 341/34
5,398,517 A * 3/1995 Poindexter ..... 62/125
5,603,431 A * 2/1997 Tuller ..... 222/63
5,725,001 A * 3/1998 Vogel ..... 134/57 D
2003/0160064 A1* 8/2003 Perucca et al. ..... 222/154
2005/0017114 A1* 1/2005 Gadini et al. ..... 242/375.1
2005/0023290 A1* 2/2005 Kon et al. ..... 222/39
2005/0155633 A1* 7/2005 Daume et al. ..... 134/25.2

FOREIGN PATENT DOCUMENTS

DE 10220839 A1 12/2003
EP 1362547 A2 4/2003
WO 2005058121 6/2005

* cited by examiner

*Primary Examiner*—Michael Cleveland
*Assistant Examiner*—Samuel A Waldbaum
(74) *Attorney, Agent, or Firm*—Robert A. Bacon; McGarry Bair PC

(57) ABSTRACT

A dishwashing machine is capable of carrying out a normal washing program with a powder detergent as well as programs using solid detergents with additives having rinse aid properties and/or water softening properties. The machine includes a detergent dispenser having three chambers. Each chamber is adapted for a specific kind of detergent. The chambers include a sensor for detecting the presence of loaded detergent and for adjusting the washing program accordingly.

13 Claims, 1 Drawing Sheet

DISHWASHING MACHINE

BACKGROUND OF THE INVENTION

1. Field of the Invention

The present invention relates to a dishwashing machine capable of carrying out a normal dishwashing program using a powder detergent as well as programs using solid detergents with additives having rinse aid properties and/or water softening properties.

2. Description of the Related Art

It is well known in the art of dishwashers the possibility of using, instead of powder detergent and liquid rinse aid, solid compositions called "2 in 1" compositions since they performs the function of the detergent and of the rinse aid which, in the traditional washing programs, has to be added in a specific "ad hoc" dispenser. There are also available on the market so called "3 in 1" solid compositions that, in addition to the above two functions (detergent+rinse aid), contain further additives having water softening purposes, therefore eliminating the need of using the water softening device and therefore the use of salt for ion exchange resins regeneration. Quite recently, the detergent producers have launched on the market "4 in 1" and "5 in 1" solid compositions or tablets, which have also other properties like a special care for stainless steel or silver and for glasses; for the purpose of the present invention "4 in 1" and "5 in 1" compositions are equivalent to "3 in 1" compositions.

The appliance producers had to adapt the range of dishwashers to the new family of detergents. Several approaches have been adopted, for instance by adding a "2 in 1" and "3 in 1" button to the user interface of the machine as disclosed by DE 10220839 A1 or by adding an "ad hoc" program to the machine, as disclosed by EP 1362547 A1, according to which the regeneration function of the water-softening device is switched off. These known solutions make the use of the dishwasher more cumbersome since the user does not usually like to have complex user interfaces with many buttons and/or a selection of too many washing programs. Moreover, there is always the possibility that the user load a "2 in 1" or "3 in 1" composition and then he/she forgets to adjust the button/program accordingly, therefore leading to a poor result of the washing program.

SUMMARY OF THE INVENTION

An aspect of the present invention is to provide a dishwashing machine which does not present the above mentioned drawbacks and which is very easy to use. A dishwasher according to the invention presents the features listed in the appended claims.

BRIEF DESCRIPTION OF THE DRAWINGS

Other advantages and features of the present invention will become clear from the following detailed description of one embodiment of the invention, with reference to the attached drawings in which.

DETAILED DESCRIPTION OF THE PREFERRED EMBODIMENTS

Figure 1:
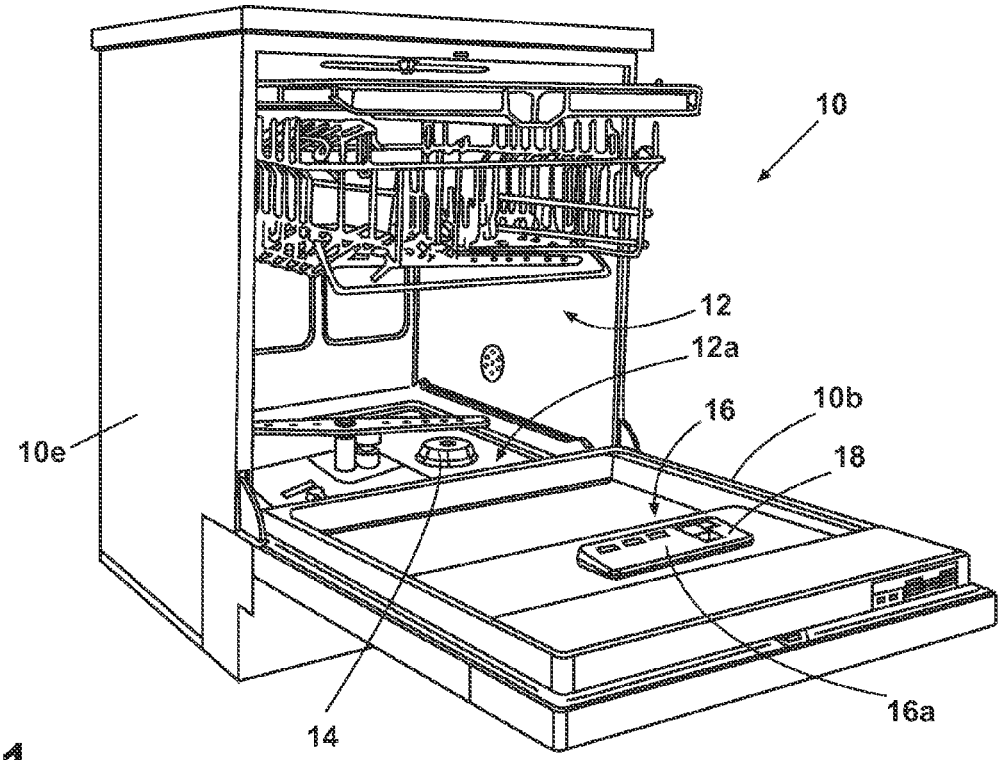
FIG. 1 is a perspective view of a dishwashing machine according to the present invention.
Figure 2:
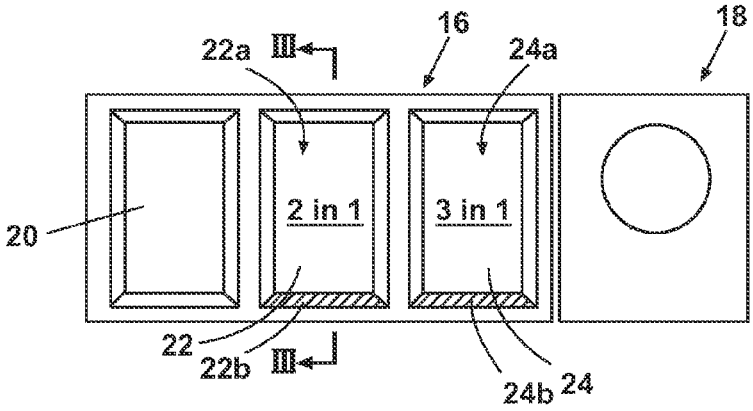
FIG. 2 is a detail in enlarged scale of FIG. 1, particularly a detail of the detergent distributor in which the lid is not shown for sake of clarity.

With reference to the drawings, a dishwasher 10 comprises a cabinet 10*a* and a front door 10*b*. The cabinet and the door define a washing chamber 12 having a bottom wall 12*a* where there is an opening for feeding salt used by the water-softening device for the regeneration of the ion exchange resins. In FIG. 1 only the lid 14 for closing the salt reservoir is shown.

On the door 10*b* a detergent distributor 16 is shown, near a distributor 18 for liquid rinse aid. The detergent distributor 16 is provided with an elongated rotating lid 16*a* covering three chambers 20, 22 and 24. The chamber 20 is intended for loading traditional powder detergent, and it may also be provided with a pre-wash basin. Chamber 22 is intended for loading tablets of solid detergent having also an additive performing a rinse aid function at the end of the washing program (the so called "2 in1" tablets). Chamber 24 is intended for loading tablets of solid detergent having additives performing a rinse aid function and a water softening function (the so called "3/4/5in1" tablets). For prompting the user to load the tablets in the correct chamber, chambers 22 and 24 present an indication 22*a* and 24*a* respectively (either on the bottom of the chamber, as shown in the drawings, or on the lid 16*a*) clarifying the purpose of each chamber. Therefore the user has no problem of loading the tablet in the correct chamber.

Figure 3:
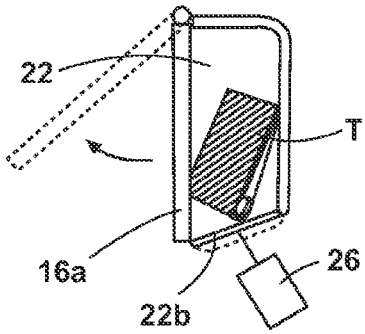
FIG. 3 is a cross section taken along line III-III of FIG. 2.

Each of chambers 22 and 24 presents a side wall 22*b* and 24*b* respectively made of flexible rubber like material so that, in the closed configuration of the door 10*b*, such side wall may be deformed by the weight of the solid detergent tablet if present in the chamber. This configuration is shown in FIG. 3 for the chamber 22, where it is shown a solid tablet T deforming by gravity the flexible wall 22*b*. Such wall, on the other side of the chamber 22, is in contact with a micro-switch 26 which sends a signal to the central process unit of the machine indicative of the presence of the "2in1" tablet. Due to this signal the machine automatically select or adjust a specific program sequence which is adapted for the "2in1" composition and which prevents the rinse aid distributor 18 from loading a rinse aid in the machine.

Similarly, when the micro-switch sensor indicates the presence of a "3in1" composition in the chamber 24, the machine automatically chooses a specific program sequence which prevents the activation of the rinse aid distributor 18 and prevents any regeneration of the resin of the water softening device, therefore bypassing such device.

Also the chamber 20 for powder detergent may be provided with a sensor as well; in order to reduce the cost of the machine such sensor is not strictly necessary since when sensors of chambers 22 and 24 indicate that no solid (tablet) detergent composition is present, the central process unit of the machine assumes that the user has loaded a powder detergent in chamber 20. A sensor in chamber 20 can guarantee that the machine does not start the washing program if no detergent is present, and an error message is set on the display accordingly.

Instead of using a micro-switch sensor, other sensors may be used as capacity sensors, foil switch sensors, reed sensors and the like.

As an alternative, each chamber 20, 22 and 24 may be provided with its own independent lid, and a micro-switch sensor can sense the closure of each lid. This system is very simple and such simplicity may counterbalance the disadvantage of a false signal when the chamber is closed but no detergent is placed in the chamber itself.

When a 3/4/5in1 tablet is used, it is important to distinguish between a situation in which the water-softening device may be kept idle and a situation in which this could cause a not satisfactory washing performance. In other words, if the water hardness is higher than a predetermined value, for instance about 22° dH, the water softening properties of the 3/4/5in1 composition is not enough for eliminating the water hardness and in this case the central process unit of the machine sets the regeneration/softening device accordingly and/or avoid a full by-passing of the water softener. When the machine has a switch for inputting the water hardness or it has a sensor for detecting automatically the hardness of water fed to the machine, the central process unit has stored therein a list of values corresponding to different rates of resin regeneration or water-softening by-passing. Such central process unit receives also signal from the sensors associated to the detergent distributor chamber 24. By combining the above information the central process unit can choose a specific rate of resin regeneration (and/or a specific degree of water softening device bypassing) in order to guarantee the proper water softening in the machine.

The processor or central process unit of the machine can have a sort of "head-up" table according to which, when a solid detergent composition having also water softening properties is used, deactivates any resin regeneration only if the hardness of water fed to the machine is lower than a predetermined value, for instance lower than about 21° dH. For higher value the central process unit chooses a predetermined degree of resin regeneration capable of supporting the insufficient water softening properties of additives in the detergent solid composition.

With a dishwasher as the one described above the user needs only to put the detergent composition in the right place (chamber); all the other selections or adjustments are carried out automatically by the machine.

I claim:

1. A dishwashing machine capable of carrying out a washing program, the dishwashing machine comprising:

a detergent dispenser with a first chamber for holding a detergent having a first detergent composition and a second chamber for holding a detergent having a second detergent composition different from the first detergent composition;

a first sensor associated with the first chamber for detecting the presence of detergent in the first chamber and generating a first signal indicative of the presence of detergent having the first detergent composition;

a second sensor associated with the second chamber for detecting the presence of detergent in the second chamber and generating a second signal indicative of the presence of detergent having the second detergent composition; and a central process unit storing a first program sequence adapted for use with the first detergent composition and a second program sequence adapted for use with the second detergent composition, with the second program sequence being different than the first program sequence, and executing the first program sequence in response to receiving first signal and executing the second program sequence in response to receiving the second signal.

2. The dishwashing machine according to claim 1, wherein the detergent dispenser has three chambers, with the first chamber for powder detergent, the second chamber for a solid detergent composition also having rinse aid properties, and a third chamber for a solid detergent composition also having rinse aid properties and water softening properties.

3. The dishwashing machine according to claim 2, wherein the three chambers have a single lid.

4. The dishwashing machine according to claim 2, wherein that each of the three chambers has its own lid.

5. The dishwashing machine according to claim 1, further comprising:

at least one wall of at least one of the first and second chambers is made of flexible material; and the sensor associated with the at least one of the first and second chamber comprising a micro-switch;

wherein the at least one wall can be deformed by the weight of detergent in the at least one of the first and second chamber, and the micro-switch senses deformation of the at least one wall.

6. The dishwashing machine according to claim 1, wherein at least one of the first and second sensors is a capacitive sensor capable of detecting the presence of detergent in the chamber associated with the capacitive sensor.

7. The dishwashing machine according to claim 1, wherein each of the first and second chambers comprises a lid and wherein each of the first and second sensors comprises a position sensor capable of detecting whether the lid of the associated chamber is open or closed.

8. The dishwashing machine according to claim 1, further comprising:

a means for determining water hardness value; and the central process unit water hardness values corresponding to different rates of resin regeneration;

wherein the central process unit uses the determined water hardness value to determine a rate of resin regeneration required to guarantee proper softening in the dishwashing machine.

9. The dishwashing machine according to claim 8, wherein the central process unit has a head-up table which deactivates any resin regeneration when a solid detergent composition having water softening properties is detected by one of the first and second sensors.

10. The dishwashing machine according to claim 1, wherein at least one of the first and second chambers has a wall made of flexible material that deforms under the weight of detergent in the at least one of the first and second chambers, and the sensor associated with the at least one of the first and second chambers senses deformation of the wall.

11. The dishwashing machine according to claim 10, wherein the sensor associated with the at least one of the first and second chambers is a micro-switch.

12. The dishwashing machine according to claim 1, further comprising a rinse aid distributor, wherein at least the second program sequence is adapted to prevent the rinse aid distributor from loading a rinse aid in the dishwashing machine.

13. The dishwashing machine according to claim 1, further comprising a water softening device, wherein at least the second program sequence is adapted to prevent the water softening device from regenerating resin.

* * * * *

UNITED STATES PATENT AND TRADEMARK OFFICE

CERTIFICATE OF CORRECTION

PATENT NO. : 7,850,787 B2
APPLICATION NO. : 11/850945
DATED : December 14, 2010
INVENTOR(S) : Josef Arnold Buser It is certified that error appears in the above-identified patent and that said Letters Patent is hereby corrected as shown below:

Col. 3, lines 39-63, Claim 1: "A dishwashing machine capable of carrying out a washing program, the dishwashing machine comprising: a detergent dispenser with a first chamber for holding a detergent having a first detergent composition and a second chamber for holding a detergent having a second detergent composition different from the first detergent composition; a first sensor associated with the first chamber for detecting the presence of detergent in the first chamber and generating a first signal indicative of the presence of detergent having the first detergent composition; a second sensor associated with the second chamber for detecting the presence of detergent in the second chamber and generating a second signal indicative of the presence of detergent having the second detergent composition; and a central process unit storing a first program sequence adapted for use with the first detergent composition and a second program sequence adapted for use with the second detergent composition, with the second program sequence being different than the first program sequence, and executing the first program sequence in response to receiving first signal and executing the second program sequence in response to receiving the second signal." - should be Claim 1: -- A dishwashing machine capable of carrying out a washing program, the dishwashing machine comprising: a detergent dispenser with a first chamber for holding a detergent having a first detergent composition and a second chamber for holding a detergent having a second detergent composition different from the first detergent composition; a first sensor associated with the first chamber for detecting the presence of detergent in the first chamber and generating a first signal indicative of the presence of detergent having the first detergent composition; a second sensor associated with the second chamber for detecting the presence of detergent in the second chamber and generating a second signal indicative of the presence of detergent having the second detergent composition; and a central process unit storing a first program sequence adapted for use with the first detergent composition and a second program sequence adapted for use with the second detergent composition, with the second program sequence being different than the first program sequence, and executing the first program sequence in response to receiving the first signal and executing the second program sequence in response to receiving the second signal. --

Signed and Sealed this
Thirty-first Day of January, 2012

David J. Kappos

David J. Kappos
*Director of the United States Patent and Trademark Office*

Col. 4, lines 11-20, Claim 5: "The dishwashing machine according to claim 1, further comprising: at least one wall of at least one of the first and second chambers is made of flexible material; and the sensor associated with the at least one of the first and second chamber comprising a micro-switch; wherein the at least one wall can be deformed by the weight of detergent in the at least one of the first and second chamber, and the micro-switch senses deformation of the at least one wall." - should be Claim 5: -- The dishwashing machine according to claim 1, further comprising: at least one wall of at least one of the first and second chambers is made of flexible material; and the sensor associated with the at least one of the first and second chambers comprising a micro-switch; wherein the at least one wall can be deformed by the weight of detergent in the at least one of the first and second chambers, and the micro-switch senses deformation of the at least one wall. --

Col. 4, lines 30-38, Claim 8: "The dishwashing machine according to claim 1, further comprising: a means for determining water hardness value; and the central process unit water hardness values corresponding to different rates of resin regeneration; wherein the central process unit uses the determined water hardness value to determine a rate of resin regeneration required to guarantee proper softening in the dishwashing machine." - should be Claim 8: -- The dishwashing machine according to claim 1, further comprising: a means for determining water hardness value; and the central process unit storing water hardness values corresponding to different rates of resin regeneration; wherein the central process unit uses the determined water hardness value to determine a rate of resin regeneration required to guarantee proper softening in the dishwashing machine. --